US010115260B2

(12) United States Patent
Lavigne et al.

(10) Patent No.: US 10,115,260 B2
(45) Date of Patent: Oct. 30, 2018

(54) METHOD FOR A BANKNOTE RECYCLER TO SELF-AUDIT

(71) Applicant: Revolution Retail Systems, LLC, Carrollton, TX (US)

(72) Inventors: Matthew O. Lavigne, Carrollton, TX (US); Jerry M. Haynes, III, Nevada, TX (US); Mark K. Levenick, Flower Mound, TX (US)

(73) Assignee: REVOLUTION RETAIL SYSTEMS, LLC, Carrollton, TX (US)

( * ) Notice: Subject to any disclaimer, the term of this patent is extended or adjusted under 35 U.S.C. 154(b) by 0 days.

(21) Appl. No.: 14/753,268

(22) Filed: Jun. 29, 2015

(65) Prior Publication Data

US 2016/0379433 A1 Dec. 29, 2016

(51) Int. Cl.

| | |
|---|---|
| ***G06M 1/00*** | (2006.01) |
| ***G06M 3/00*** | (2006.01) |
| ***G07D 11/00*** | (2006.01) |
| ***G07D 7/00*** | (2016.01) |
| ***B65H 29/00*** | (2006.01) |
| ***B65H 31/24*** | (2006.01) |
| ***B65H 83/00*** | (2006.01) |

(52) U.S. Cl.

CPC ..... *G07D 11/0084* (2013.01); *B65H 29/001* (2013.01); *B65H 31/24* (2013.01); *B65H 83/00* (2013.01); *G07D 7/00* (2013.01); *G07D 11/0021* (2013.01); *G07D 11/0075* (2013.01); *B65H 2301/422542* (2013.01); *B65H 2301/541* (2013.01); *B65H 2405/331* (2013.01); *B65H 2557/65* (2013.01); *B65H 2701/1912* (2013.01)

(58) Field of Classification Search

CPC ..... B65H 5/00; B65H 5/002; B65H 33/00; B65H 29/00; B65H 29/001; B65H 2301/422542; B65H 2301/541; B65H 2405/361; B65H 2701/1912; G07D 11/0021; G07D 11/0084; G07D 11/006; G07D 11/0075

USPC .... 271/3.01, 3.14, 9.01, 9.03, 279; 209/534; 194/206, 207

See application file for complete search history.

(56) References Cited

U.S. PATENT DOCUMENTS 3,965,913 A * 6/1976 Tokura ..... G07D 11/0018 221/7

5,826,680 A * 10/1998 Takemoto ..... G07D 11/0015 186/37

(Continued)

*Primary Examiner* — Prasad V Gokhale

(74) *Attorney, Agent, or Firm* — Locke Lord LLP; Charles E. Phipps

(57) ABSTRACT

The present invention relates generally to a method for a banknote recycler to perform a self-audit of the contents of the recycler's recycling cassettes without the assistance of a human operator. The method involves the transforming of the deposit cassette into a temporary recycling cassette after the deposit cassette has been emptied of its contents. The banknotes are validated and counted as they are moved from the recycling cassette into the empty deposit cassette, which serves as the banknote storage area. After the audit of the recycling cassette is complete, the banknote recycler is then instructed to move the notes from the deposit cassette back into the appropriate recycling cassette. These same steps can be performed for each recycling cassette in the banknote recycler that is desired to be audited.

12 Claims, 3 Drawing Sheets

(56) References Cited

U.S. PATENT DOCUMENTS

| | | | | |
|---|---|---|---|---|
| 7,234,635 | B2 * | 6/2007 | Tsuchiya | G06Q 20/1085 235/375 |
| 8,272,563 | B1 * | 9/2012 | Folk | G07D 11/0081 235/379 |
| 8,714,335 | B2 * | 5/2014 | Hallowell | B65B 27/08 194/206 |
| 9,734,650 | B2 * | 8/2017 | Togiya | B65H 85/00 |
| 2002/0088850 | A1 * | 7/2002 | Katou | B65H 29/006 235/379 |
| 2003/0042300 | A1 * | 3/2003 | So | G07D 11/0039 235/379 |
| 2003/0173183 | A1 * | 9/2003 | Katou | B65H 1/025 194/206 |

* cited by examiner

METHOD FOR A BANKNOTE RECYCLER TO SELF-AUDIT

BACKGROUND OF THE INVENTION

1. Field of the Invention

The present invention relates generally to a method for a banknote recycler to self-audit to determine the contents of the banknote recycler. More specifically, the invention relates to a method for a banknote recycler to self-audit by temporarily converting the deposit cassette into a recycling cassette and validating and counting the contents from an additional recycling cassette as it is moved into the converted deposit cassette (i.e., temporary recycling cassette), storing this information in the software and then moving the contents back to the original recycling cassette.

2. Description of Related Art

Banknote recyclers are typically used in retail, banking, automated teller machines and other cash-based operations where banknotes of various denominations are validated, counted and sorted for subsequent use. For example, a retail or banking cashier at the beginning of a shift requires an amount of bills in various denominations to use in a cash till drawer for dispensing change to customers. A typical banknote recycler has provisions for accepting banknotes of mixed denomination and then separating, validating, counting and sorting the banknotes. The accepted notes of each denomination are then placed into various recycling cassettes configured to receive that specific denomination. These recycling cassettes are capable of dispensing stored notes for use by the store in its operation, which is why they are called recycling cassettes. Low-quality notes and notes of denominations with no recycler cassette configured to accept that denomination are placed into one or more deposit cassettes, where they remain until picked up by a cash-in-transit courier or by the responsible party of the recycler who removes the bills for deposit. The banknote recyclers also have the capability to move notes from the recycling cassettes to the deposit cassette to raise the content of the deposit cassette to the desired monetary value for subsequent retrieval by the cash-in-transit courier. Typically, operators of banknote recyclers do not have the ability to remove notes once they have been placed inside the deposit cassette, as the deposit cassette is locked in place by the cash-in transit courier or the responsible party in the bank or retail environment. Banknote recyclers can be integrated into a coin and note (or note-only) cash recycling system where it is controlled by a set of software programs running on a computer.

It is necessary or desirable for the owner of the banknote recycler to audit the contents of the recycling cassettes from time-to-time. For example, the recycling cassettes may need to be audited when an accounting discrepancy is noticed or suspected, when a recycling cassette has been removed and replaced, or anytime the owner desires to audit the contents. Prior art banknote recyclers are typically audited using a labor- and time-intensive process where a human operator must manually empty the recycling cassette(s) to be audited and then manually feed the notes back into the banknote recycler. Prior art banknote recyclers are not capable of performing a self-audit wherein the current contents of each recycling cassette can be validated and counted automatically because there is no built-in audit functionality in the software and because there is no separate banknote storage area to store the bills as they are being validated and counted before being returned to the proper recycling cassette.

It is therefore desirable to have a banknote recycler capable of performing a self-audit of the contents of individual recycling cassettes, which does not involve the assistance by a human operator of the banknote recycler.

SUMMARY OF THE INVENTION

The present invention provides generally for a method for a banknote recycler to perform a self-audit of the contents of the recycler's recycling cassettes without the assistance of a human operator. Generally the method of present invention operates by transforming the deposit cassette into a temporary recycling cassette after the deposit cassette has been emptied of its contents by the cash-in-transit courier or other personnel responsible for the deposit cassette. The banknotes are validated and counted as they are moved from the recycling cassette into the empty deposit cassette, which serves as the banknote storage area. Providing this temporary storage area for the banknotes as they are counted and validated from the recycling cassette allows the present invention to perform a self-audit that was not possible with the prior art banknote recyclers. After the audit of the recycling cassette is complete, the banknote recycler is then instructed to move the notes from the deposit cassette back into the appropriate recycling cassette. These same steps can be performed for each recycling cassette that is desired to be audited.

The specific steps of the method for self-auditing of the present invention are described below. First, at some point during operation of the banknote recycler, the operating software records the desire to perform a self-audit at the next emptying of the deposit cassette by the cash-in-transit courier or responsible party. The desire to perform a self-audit is either entered by the operator of the banknote recycler (locally at the machine or remotely via an internet connection) or automatically triggered by an event such as removal of a recycle cassette, accounting discrepancy or other security event. Once the deposit cassette is emptied by the cash-in-transit courier, it can then be used as a temporary recycling cassette and the self-audit of the requested recycling cassettes can begin. Next, the software commands the banknote recycler to move the contents of the desired recycling cassette into the empty deposit cassette. The banknote recycler carries out this move, and the contents of the recycling cassette are validated and counted as it is emptied. The count of banknotes is recorded by the operating software. Then, the operating software commands the banknote recycler to temporarily re-configure the recycling and deposit cassettes to allow the banknotes to be moved back from the deposit cassette into the original recycling cassette. Any additional recycling cassettes that are desired to be audited would then follow the same steps described above. After the banknotes are moved back to the original recycling cassette, the operating software commands the banknote recycler to return to its normal operating cassette configuration.

The novel features and construction of the present invention, as well as additional objects thereof, will be understood more fully from the following description when read in connection with the accompanying drawings.

BRIEF DESCRIPTION OF THE DRAWINGS

The invention is further described and explained in relation to the following figures of the drawings wherein.

Like reference numerals are used to describe like parts in all figures of the drawings.

DESCRIPTION OF THE PREFERRED EMBODIMENTS

Figure 1:
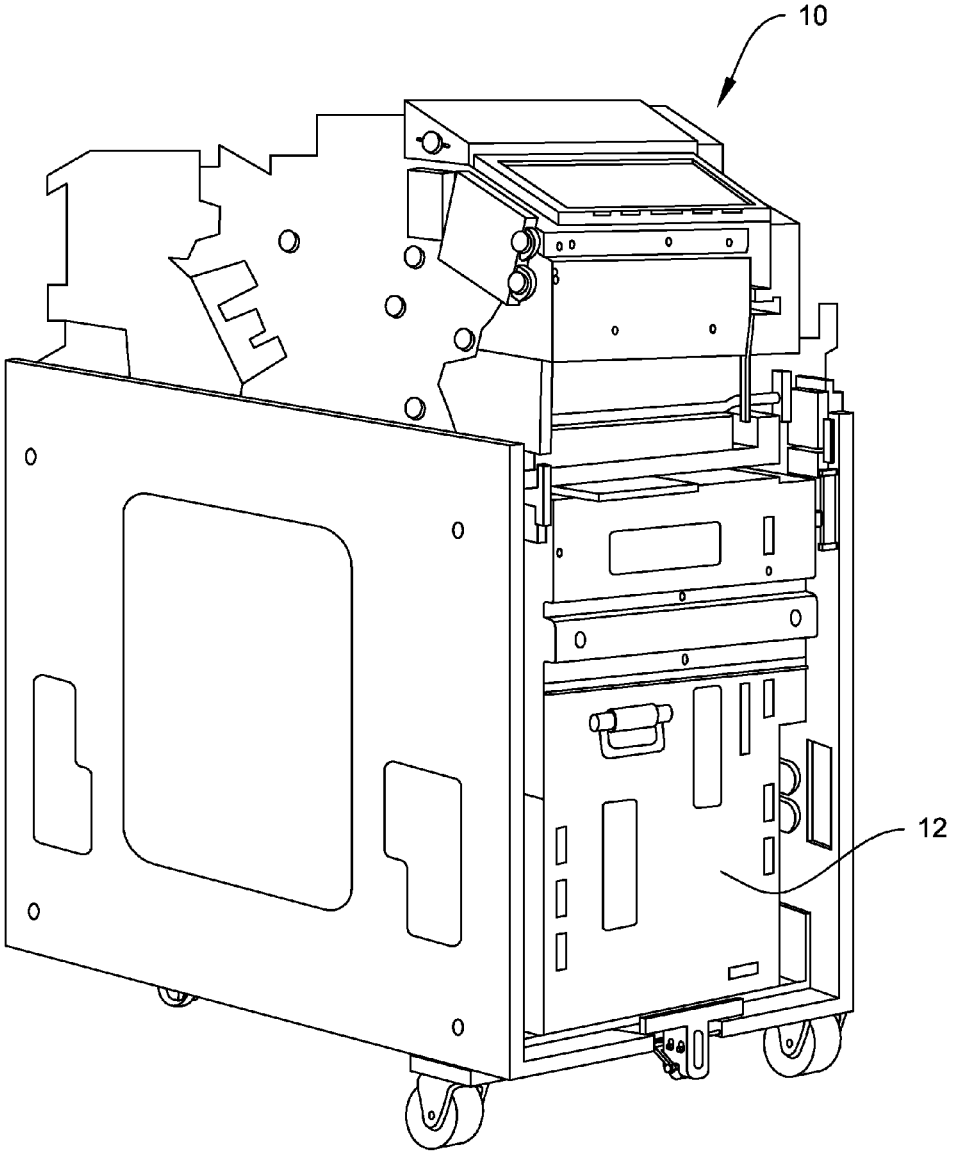
FIG. 1 is a perspective view of a banknote recycler with the cassette housing drawer closed.

Referring to FIG. 1, banknote recycler 10 is shown. Banknote recycler 10 is typically integrated into a coin and note (or note-only) cash recycling system. These cash recycling systems are controlled by a computer running a set of software programs that run the individual components of the system, including banknote recycler 10. Banknote recycler 10 comprises a banknote acceptor to accept banknotes of mixed denomination and is capable of separating, validating, counting and sorting the banknotes. Banknote recycler 10 further comprises cassettes (not shown), which are configured to store banknotes. The cassettes are housed in cassette housing drawer 12, which is in a closed position during operation of banknote recycler 10. In its closed position, cassette housing drawer 12 houses the cassettes under the area of banknote recycler 10 where the banknotes are separated, validated, counted and sorted.

Figure 2:
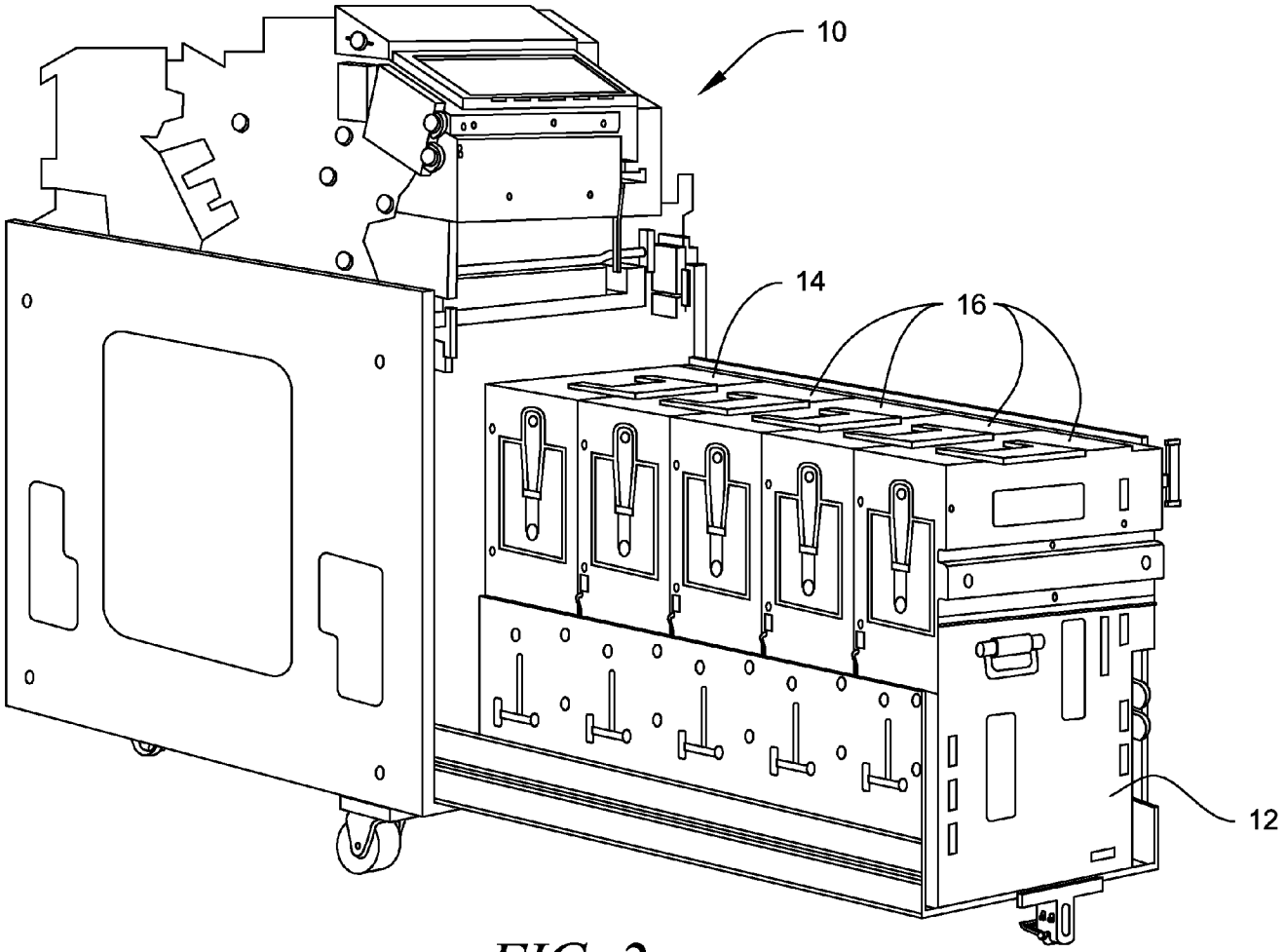
FIG. 2 is a perspective view of the banknote recycler with the cassette housing drawer extended.

Referring to FIG. 2, banknote recycler 10 is shown with cassette housing drawer 12 in its extended open position. Cassette housing drawer 12 is extended when the banknote recycler operator or the cash-in-transit courier needs access to the cassettes. Banknote recycler 10 shown here has five cassettes (14, 16). In this typical setup, four of the cassettes are configured as recycling cassettes 16 and one is configured as deposit cassette 14. Recycling cassettes 16 are configured to receive banknotes of specific denominations. Typically in this four recycling cassette setup, one recycling cassette 16 will store $1 bills, another $5 bills, another $10 bills and the last $20 bills. Recycling cassettes 16 are capable of dispensing the stored banknotes for re-use by the operator of banknote recycler 10. Deposit cassette 14 houses bills of multiple denominations that are either of low-quality or when there is no recycling cassette configured to accept that denomination (e.g., $100 bill in the above example). Additionally, the operator can control banknote recycler 10 to have recycling cassettes 16 dispense banknotes into deposit cassette 14 to a desired monetary value for subsequent retrieval by the cash-in-transit courier.

Figure 3:
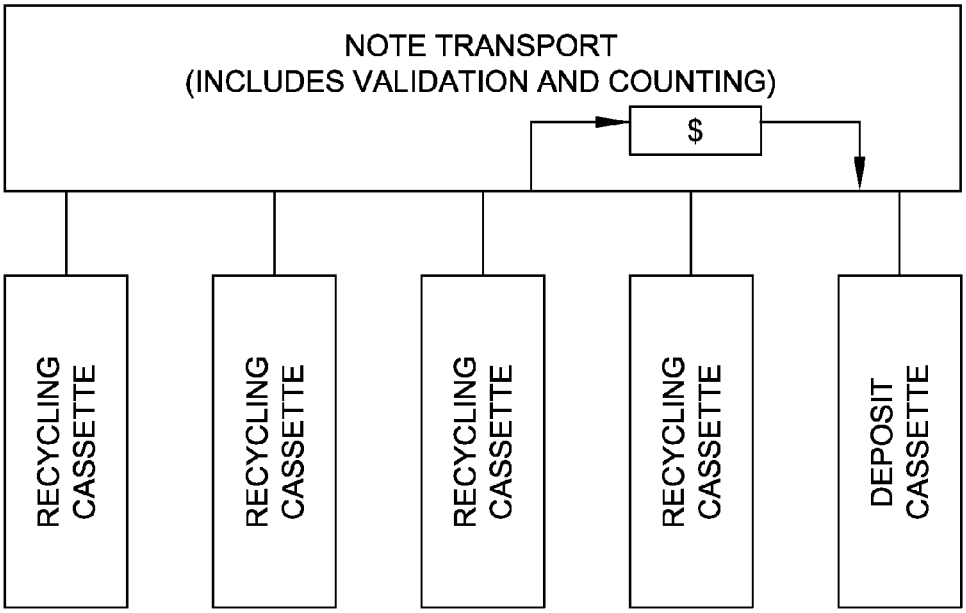
FIG. 3 is a flow chart of the first portion of the self-auditing operation of a banknote recycler.

Referring to FIG. 3, the first portion of the self-auditing method for banknote recycler 10 of the present invention is shown. Before a self-audit of any recycling cassette is performed, the operating software records the desire to perform a self-audit, which will be performed the next time the deposit cassette is emptied by the cash-in-transit courier. The operator of banknote recycler 10 may desire to run self-audits of each recycling cassette each time the deposit cassette is emptied or may choose to run self-audits of only selected cassettes at selected times, such as after a jammed banknote is cleared from one of the recycling cassettes. Additionally, the operating software may automatically run self-audits of any recycling cassette that have been lifted (temporarily removed) or replaced since the previous cash-in-transit courier visit. Once the deposit cassette is empty, the operating software begins the self-audit process for the selected recycling cassette. Every banknote in the selected recycling cassette is transported from the recycling cassette into the deposit cassette. In the preferred embodiment, as the banknotes are dispensed from the recycling cassette, they are counted as they are moved into the deposit cassette. This count is recorded by the operating software. Additionally, the notes can be validated as they are transported from the recycling cassette into the deposit cassette. At this point in the process, the deposit cassette is now storing the contents of the selected recycling cassette, which is now empty and the operating software has recorded the number of banknotes that were housed in the recycling cassette. No cassettes have been reconfigured at this point, and each have operated as they do under normal circumstances (i.e., the recycling cassette dispensed the banknotes and the deposit cassette received the banknotes).

Figure 4:
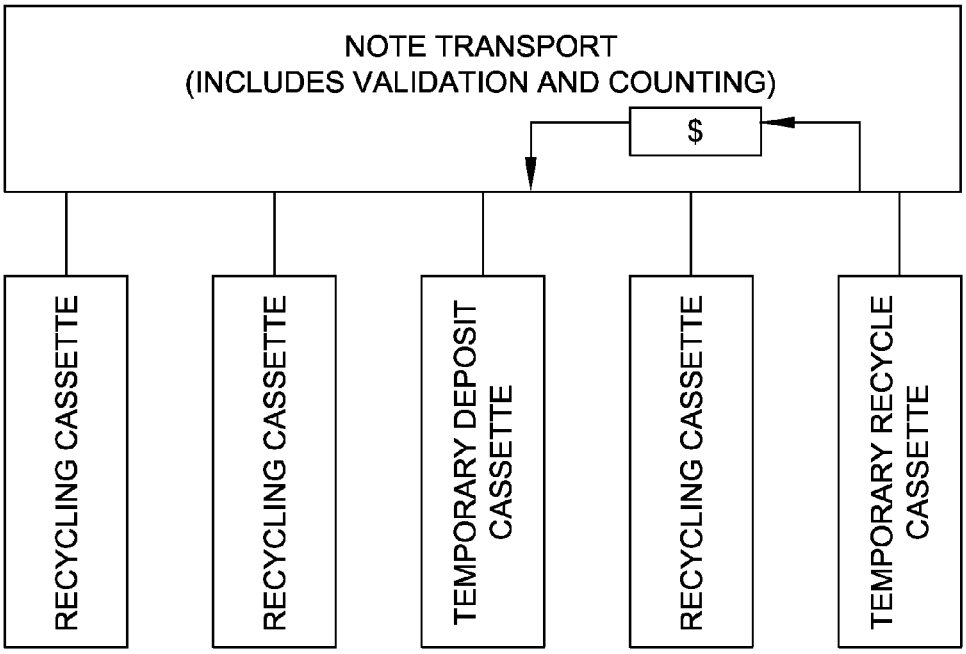
FIG. 4 is a flow chart of the second portion of the self-auditing operation of the banknote recycler.

Referring to FIG. 4, the second portion of the self-auditing method for banknote recycler 10 of the present invention is shown. The first step of the second portion of the self-auditing method is to have the operating software reconfigure the deposit cassette as a temporary recycling cassette because under normal operation, the deposit cassette does not dispense banknotes as is done by the recycling cassettes. Next, the now-empty recycling cassette is reconfigured as a temporary deposit cassette to allow it to accept banknotes from another cassette. After the reconfiguration of the two affected cassettes, the operating software directs the temporary recycling cassette (original deposit cassette) to transport its contents to the temporary deposit cassette (original recycling cassette). Because the notes were counted as they were being transported in the first portion of the self-audit in the preferred embodiment, there is no need to count the bills again as they are being moved back. However, in an alternative embodiment, the notes can be again counted, and the count is again recorded by the operating software. In a further alternative embodiment, the notes could be transported in the first portion without counting and only be counted as they are being transported back in the second portion of the self-audit. Once the contents of the original recycling cassette are back in the original recycling cassette, the operating software reconfigures it back from the temporary deposit cassette into the original recycling cassette. Likewise, once the original deposit cassette is empty, the operating software reconfigures it back from the temporary recycling cassette into the original deposit cassette. The same steps as shown in FIGS. 3 and 4 are then repeated for each recycling cassette desired to be audited.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

The invention claimed is:

1. A method for self-auditing contents of a banknote recycler with at least one banknote recycling cassette and one banknote deposit cassette, said method comprising the steps of:

verifying by the banknote recycler that at least the deposit cassette is empty;

transporting by the banknote recycler banknotes from the recycling cassette into the deposit cassette until the recycling cassette is empty;

converting by the banknote recycler the deposit cassette from a first state into a second state, wherein in the first state the deposit cassette is a locked deposit cassette, and wherein in the second state the deposit cassette is an unlocked temporary recycling cassette from which banknotes can be withdrawn; and transporting by the banknote recycler the banknotes from the deposit cassette back into the recycling cassette;

wherein the second transporting step further comprises counting by the banknote recycler the banknotes being transported.

2. The method of claim 1 further comprising validating the banknotes during the second transporting step.

3. The method of claim 1 wherein the first transporting step further comprises counting the banknotes being transported.

4. The method of claim 3 further comprising validating the banknotes during the first transporting step.

5. The method of claim 3 further comprising recording the count of banknotes being transported in the first transport step.

6. The method of claim 1 further comprising recording the count of banknotes being transported in the second transport step.

7. A method for self-auditing contents of a banknote recycler with at least one banknote recycling cassette and one banknote deposit cassette, said method comprising the steps of:

verifying by the banknote recycler that the deposit cassette is empty;

transporting by the banknote recycler banknotes from the recycling cassette into the deposit cassette until the recycling cassette is empty;

converting by the banknote recycler the deposit cassette from a first state into a second state, wherein in the first state the deposit cassette is a locked deposit cassette, and wherein in the second state the deposit cassette is an unlocked temporary recycling cassette from which banknotes can be withdrawn;

converting by the banknote recycler the recycling cassette into a temporary deposit cassette;

transporting by the banknote recycler the banknotes from the temporary recycling cassette into the temporary deposit cassette;

wherein the first transporting step further comprises counting by the banknote recycler the banknotes being transported.

8. The method of claim 7 further comprising validating the banknotes during the first transporting step.

9. The method of claim 7 wherein the second transporting step further comprises counting the banknotes being transported.

10. The method of claim 9 further comprising validating the banknotes during the second transporting step.

11. The method of claim 9 further comprising recording the count of banknotes being transported in the second transport step.

12. The method of claim 7 further comprising recording the count of banknotes being transported in the first transport step.

* * * * *